US008516646B1

(12) United States Patent
Yang

(10) Patent No.: US 8,516,646 B1
(45) Date of Patent: Aug. 27, 2013

(54) DUSTING CLOTH STRUCTURE FOR USE WITH DUSTER

(71) Applicant: Ya-Ching Yang, Taipei (TW)

(72) Inventor: Ya-Ching Yang, Taipei (TW)

( * ) Notice: Subject to any disclaimer, the term of this patent is extended or adjusted under 35 U.S.C. 154(b) by 0 days.

(21) Appl. No.: 13/747,480

(22) Filed: Jan. 23, 2013

(30) Foreign Application Priority Data

Apr. 13, 2012 (TW) ..... 101206828 A

(51) Int. Cl.
*A47L 13/20* (2006.01)
*A47L 13/38* (2006.01)

(52) U.S. Cl.
USPC ..... 15/229.7; 15/226; 15/229.3; 15/229.4; 15/229.8

(58) Field of Classification Search
USPC ..... 15/226, 229.1, 229.2, 229.3, 229.4, 15/229.5, 229.6, 229.7, 229.8, 229.9
See application file for complete search history.

(56) References Cited

U.S. PATENT DOCUMENTS 6,813,801 B2 * 11/2004 Tanaka et al. ..... 15/229.3
7,870,635 B2 * 1/2011 Yamada ..... 15/230
8,359,699 B2 * 1/2013 Tanaka ..... 15/229.3

* cited by examiner

*Primary Examiner* — Randall Chin

(57) ABSTRACT

A dusting cloth structure for use with a duster includes a sleeve body whose outer surface is provided with a pile layer or a cloth strip layer and which has a receiving groove therein for receiving an external duster shank. One end of the sleeve body is formed with a sleeve opening. A portion of the sleeve body that is away from the sleeve opening is formed with a dividing portion extending toward the sleeve opening. The dividing portion defines two end grooves in the sleeve body, wherein the end grooves are divided from each other and communicate with the receiving groove. Moreover, the inner wall of the receiving groove is formed with a joint accommodating groove along the vertical direction of the surface of the sleeve body to prevent the sleeve body from coming off the shank.

9 Claims, 5 Drawing Sheets

DUSTING CLOTH STRUCTURE FOR USE WITH DUSTER

BACKGROUND OF THE INVENTION

1. Technical Field

The present invention relates to a dusting cloth structure for use with a duster. More particularly, the present invention relates to a dusting cloth which is configured to be mounted around the shank of a duster and which is rapidly detachable for replacement. Even more particularly, the present invention relates to a sleeve body and a pile layer or cloth strip layer that constitute such a dusting cloth and to the receiving groove and end grooves of the sleeve body.

2. Description of Related Art

A conventional duster consists essentially of a dusting cloth capable of picking up dust and a shank for supporting and securing the dusting cloth. The dusting cloth typically has a pile layer or a cloth strip layer on its surface.

To use the duster, the front end of the shank is inserted into a receiving groove formed by the dusting cloth, so as for the front end of the shank to support the dusting cloth and thereby stretch and straighten the dusting cloth. Then, by holding and waving the shank, the pile layer or cloth strip layer on the surface of the dusting cloth can be used to pick up dust.

The dusting cloth of the aforesaid duster picks up dust in two ways. One way is for the fibrous structures of the pile layer to collect dust, and the other way is for the positive charges on the pile layer to attract negatively charged dust.

When dirty, the dusting cloth can be directly detached from the shank and rapidly replaced by a new one. As it is not necessary to replace the entire duster, environmental protection requirements are met.

However, as is often the case, the dusting cloth and the shank of the aforesaid duster are not securely connected in the assembled state. The dusting cloth tends to get loose or even come off the shank while the duster is moved to and fro in a wiping process. Consequently, the use of the duster is rendered inconvenient, which demands solutions from those skilled in the art.

BRIEF SUMMARY OF THE INVENTION

It is an object of the present invention to provide a dusting cloth for use with a duster, wherein the dusting cloth is mounted around the shank of a duster and can be rapidly detached for replacement, thereby overcoming the aforementioned drawbacks of the prior art, namely the typical insecure connection between the dusting cloth and the shank in the assembled state and the loosening, or even coming-off, of the dusting cloth from the shank. The present invention effectively strengthens the connection between the dusting cloth and the shank and thus enhances convenience of use.

To achieve the above object, the present invention provides a dusting cloth structure for use with a duster. The dusting cloth structure includes a sleeve body whose outer surface is provided with a pile layer or a cloth strip layer. The sleeve body has a receiving groove therein for receiving an external duster shank and has one end formed with a sleeve opening in communication with the receiving groove. The dusting cloth structure has the following technical features:

A portion of the sleeve body that is away from the sleeve opening is formed with a dividing portion extending toward the sleeve opening. The dividing portion defines two end grooves in the sleeve body, wherein the end grooves are divided from each other and communicate with the receiving groove. The inner wall of the receiving groove is formed with a joint accommodating groove along the vertical direction of the surface of the sleeve body.

After the insertion legs of the duster shank are inserted along with the shank into the receiving groove of the sleeve body via the sleeve opening, the front end of the shank is received in the receiving groove, and the insertion legs are inserted in the end grooves respectively. As a result, the dividing portion is clamped between the insertion legs, and a joint portion of the shank is fitted in the joint accommodating groove. With the insertion legs clamping the dividing portion, and the joint accommodating groove restricting movement of the joint portion, the sleeve body is firmly positioned on the duster shank. Thus, the connection between the dusting cloth and the shank is reinforced to prevent the dusting cloth from coming off the shank, and the convenience with which the duster can be used is increased.

Implementation of the present invention is further described as follows.

In addition to the foregoing structural features, the pile layer or the cloth strip layer is provided on a single side of the sleeve body.

In addition to the foregoing structural features, the sleeve body is composed of a first cloth sheet and a second cloth sheet bonded together. The receiving groove and the end grooves are formed between the first cloth sheet and the second cloth sheet. The sleeve opening is formed between one end side of the first cloth sheet and the corresponding end side of the second cloth sheet. The joint accommodating groove is formed on the inner side of the first cloth sheet. The end grooves can be respectively inserted by two insertion legs at the front end of the external duster shank. The joint accommodating groove can receive a joint portion provided in a middle section of the external duster shank.

In addition to the foregoing structural features, the periphery of the first cloth sheet and the periphery of the second cloth sheet are hot-pressed together to form a plurality of hot-sealed nodes and to thereby bond the two cloth sheets together.

In addition to the foregoing structural features, a portion of the sleeve body that corresponds in position to the area between the two insertion legs at the front end of the external duster shank is formed with a plurality of hot-sealed nodes that constitute the dividing portion.

In addition to the foregoing structural features, the sleeve body is formed with a through hole which is adjacent to the sleeve opening and through which an engaging hook on the external duster shank can extend out of the sleeve body so that the sleeve body is fastened to the engaging hook of the duster shank and secured in place by means of the through hole.

In addition to the foregoing structural features, a positioning hole is formed between the insertion legs and corresponds in position to the dividing portion, and the engaging hook can be inserted into the positioning hole along the dividing portion.

In addition to the foregoing structural features, a width-reduced neck is formed on the inner wall of the receiving groove along the horizontal direction of the surface of the sleeve body.

In addition to the foregoing structural features, the periphery of the sleeve body has a contour characterized by alternating ridges and grooves, and the pile threads of the pile layer or the cloth strips of the cloth strip layer are unevenly distributed along the contour characterized by the alternating ridges and grooves.

BRIEF DESCRIPTION OF THE SEVERAL VIEWS OF THE DRAWINGS

The structure as well as a preferred mode of use, further objects, and advantages of the present invention will be best understood by referring to the following detailed description of some illustrative embodiments in conjunction with the accompanying drawings, in which.

DETAILED DESCRIPTION OF THE INVENTION

Figure 1:
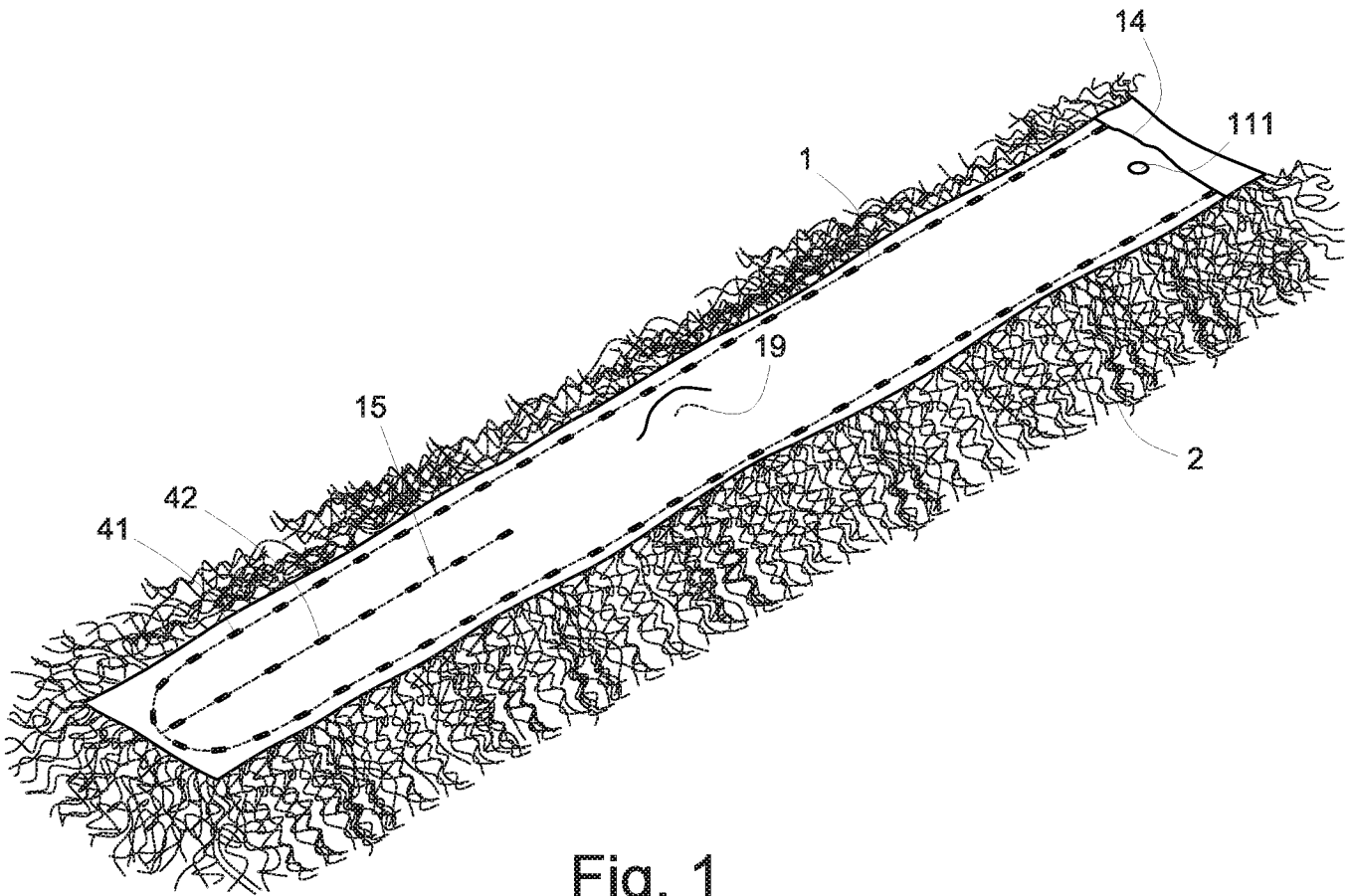
FIG. 1 is a perspective view of a preferred embodiment of the present invention.
Figure 2:
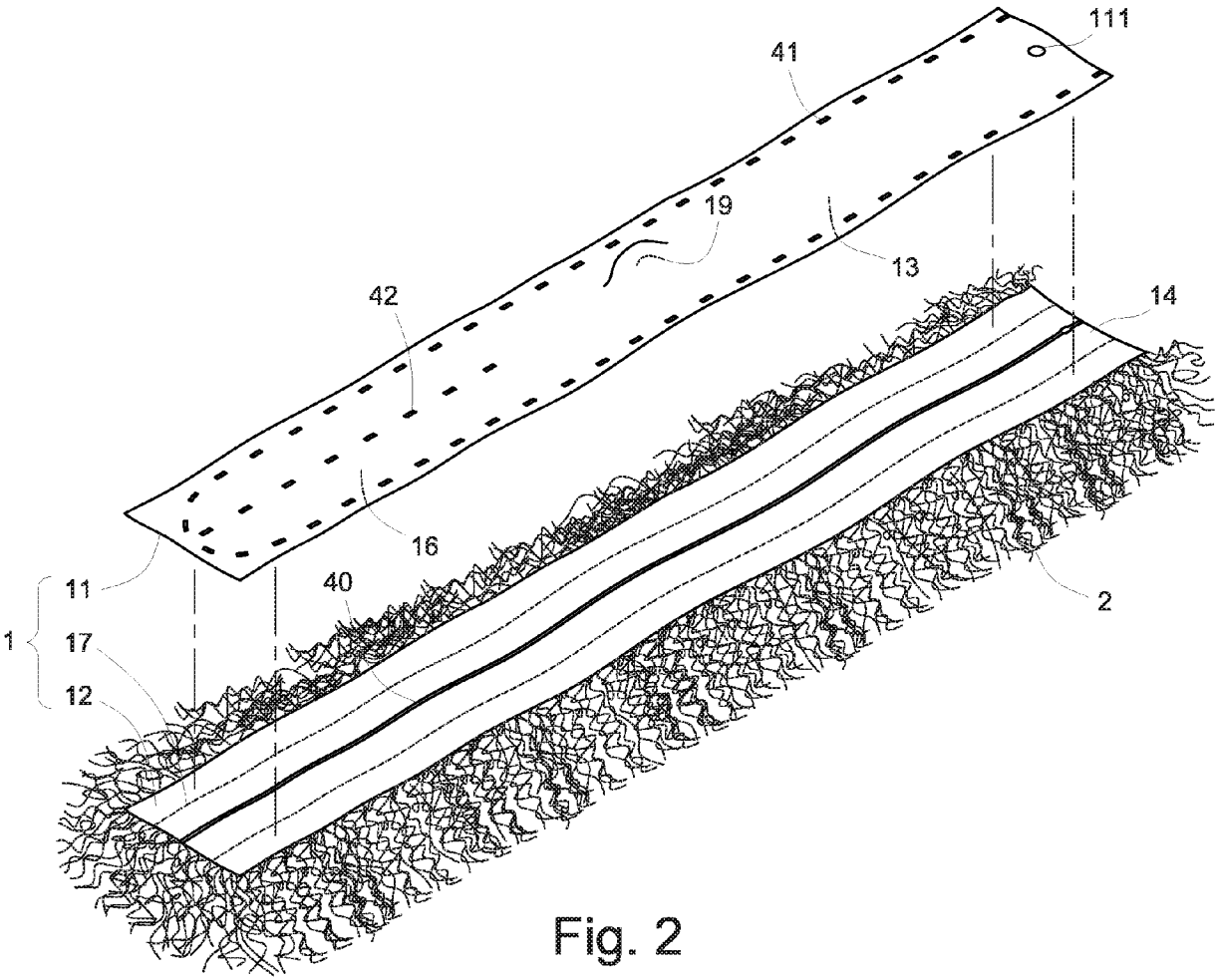
FIG. 2 is an exploded perspective view of FIG. 1.
Figure 3:
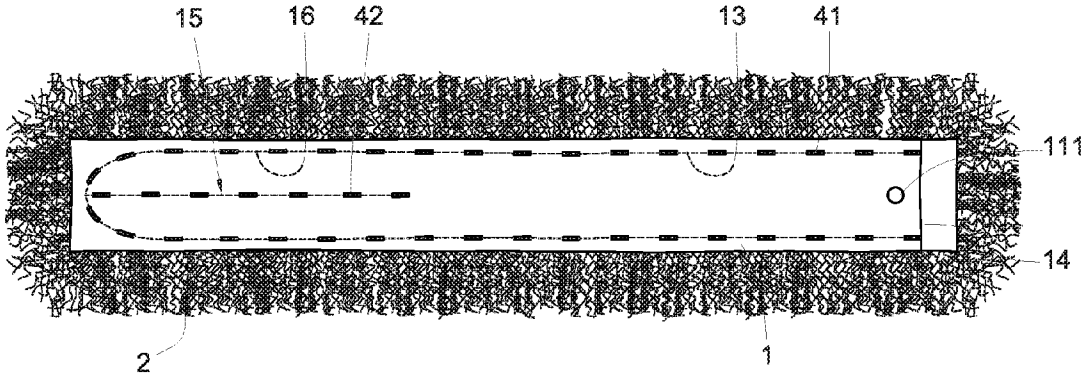
FIG. 3 is a top view of FIG. 1.
Figure 4:
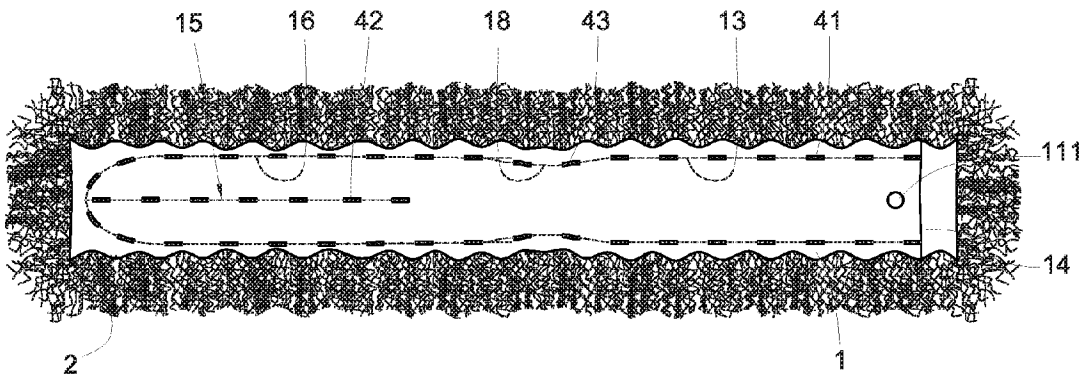
FIG. 4 is a top view similar to FIG. 3 but showing an additional mode of implementation.
Figure 5:
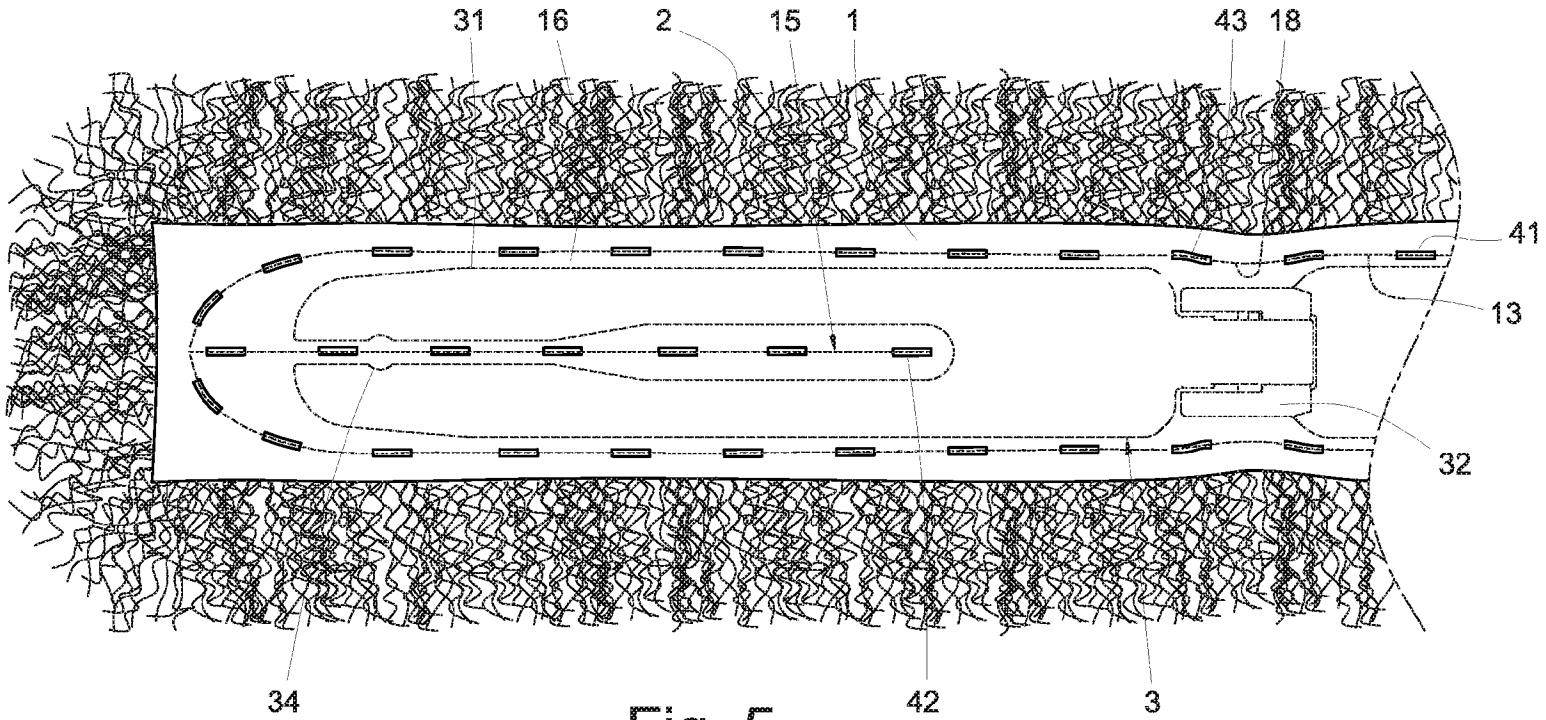
FIG. 5 is a partial top view of FIG. 1.
Figure 6:
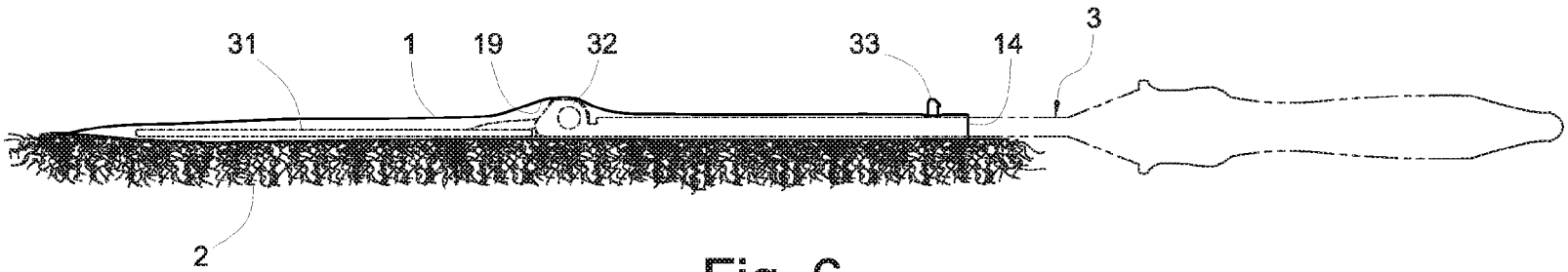
FIG. 6 is a side view showing a state of use of the embodiment depicted in FIG. 1.
Figure 7:
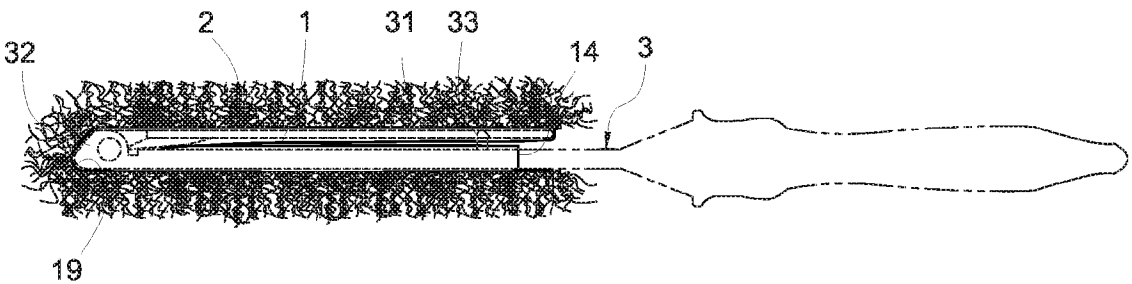
FIG. 7 is a side view showing another state of use of the embodiment depicted in FIG. 1.

Please refer to FIG. 1 for a perspective view of a preferred embodiment of the present invention; FIG. 2 for an exploded perspective view of FIG. 1; FIG. 3 for a top view of FIG. 1; FIG. 4 for a top view similar to FIG. 3 but showing an additional mode of implementation; FIG. 5 for a partial top view of FIG. 1; FIG. 6 for a side view showing a state of use of the embodiment depicted in FIG. 1; and FIG. 7 for a side view showing another state of use of the embodiment depicted in FIG. 1. According to the present invention and as shown in the drawings, a dusting cloth structure for use with a duster includes a sleeve body 1. The outer surface of the sleeve body 1 is provided with a pile layer 2 or a cloth strip layer. A receiving groove 13 is formed in the sleeve body 1 and is configured for receiving an external duster shank 3. One end of the sleeve body 1 is formed with a sleeve opening 14 in communication with the receiving groove 13, allowing the shank 3 to be inserted into and drawn out of the receiving groove 13 through the sleeve opening 14.

A portion of the sleeve body 1 that is away from and corresponds in position to the sleeve opening 14 is formed with a dividing portion 15 extending toward the sleeve opening 14. The dividing portion 15 defines two end grooves 16 in the sleeve body 1. The end grooves 16 are divided from each other and communicate with the receiving groove 13. Two insertion legs 31 provided at the front end of the shank 3 can be inserted into the end grooves 16 respectively.

The sleeve body 1 can be folded together with the shank 3. A joint accommodating groove 19 is provided in a middle section of the receiving groove 13 and is formed on the inner wall thereof along the vertical direction of the surface of the sleeve body 1. The joint accommodating groove 19 communicates with the receiving groove 13 and is configured for receiving an enlarged joint portion 32 provided in a middle section of the shank 3. The joint portion 32 is designed to enable folding of the shank 3.

The pile layer 2 or the cloth strip layer is located on a single side of the sleeve body 1. In this embodiment, the pile layer 2 or the cloth strip layer is located on the bottom surface of the sleeve body 1.

The sleeve body 1 is composed of a first cloth sheet 11 and a second cloth sheet 12 bonded together. The receiving groove 13 and the end grooves 16 are formed between the first cloth sheet 11 and the second cloth sheet 12. The sleeve opening 14 is formed between one end side of the first cloth sheet 11 and the corresponding end side of the second cloth sheet 12. The joint accommodating groove 19 is formed on the bottom surface of the first cloth sheet 11.

The periphery of the first cloth sheet 11 and the periphery of the second cloth sheet 12 are hot-pressed together to form a plurality of hot-sealed nodes 41, thereby bonding the two cloth sheets together. In addition, a portion of the first cloth sheet 11 that corresponds in position to the area between the insertion legs 31 is hot-pressed on a portion of the second cloth sheet 12 that corresponds in position to the area between the insertion legs 31, thereby forming a plurality of hot-sealed nodes 42 that form the dividing portion 15.

The first cloth sheet 11 of the sleeve body 1 is formed with a through hole 111 adjacent to the sleeve opening 14. An engaging hook 33 on a top portion of the shank 3 can extend out of the sleeve body 1 through the through hole 111 such that the sleeve body 1 is fastened to the engaging hook 33 of the shank 3 and fixed in position by means of the through hole 111.

A positioning hole 34 is formed between the insertion legs 31 and corresponds in position to the dividing portion 15 such that the engaging hook 33 is insertable into the positioning hole 34 along the dividing portion 15.

The pile threads of the pile layer 2 or the cloth strips of the cloth strip layer are provided between a bottom portion of the second cloth sheet 12 of the sleeve body 1 and a cloth strip 17. The second cloth sheet 12, the cloth strip 17, and the pile threads of the pile layer 2 or the cloth strips of the cloth strip layer are hot-pressed together in such a way that a hot-sealed line 40 is formed to bond the pile threads of the pile layer 2 or the cloth strips of the cloth strip layer to the bottom surface of the second cloth sheet 12 of the sleeve body 1.

The joint portion 32 is adjacent to a middle section of the shank 3 and allows the shank 3 to be swung to a straight-line state in which the sleeve body 1 is straightened and the duster is extended at full length in order to clean large area-surfaces. The joint portion 32 also allows the shank 3 to be swung to a folded state in which the sleeve body 1 is in a folded state and the duster is shortened in order to clean complex surfaces.

According to the above, after the insertion legs 31 are inserted along with the shank 3 into the receiving groove 13 of the sleeve body 1 via the sleeve opening 14, the front end and the insertion legs 31 of the shank 3 are received in the receiving groove 13. More specifically, the insertion legs 31 are inserted into the end grooves 16 respectively such that the dividing portion 15 is clamped between the insertion legs 31. Moreover, the insertion legs 31 form a tight fit with the inner walls of the end grooves 16 while the joint portion 32 of the shank 3 is fitted in the joint accommodating groove 19.

At the same time, the engaging hook 33 of the shank 3 extends out of the sleeve body 1 through the through hole 111, thereby positioning the sleeve body 1 on the shank 3.

Thus, with the insertion legs 31 clamping the dividing portion 15, the sleeve body 1 is securely positioned on the shank 3 and the insertion legs 31; and with the joint accommodating groove 19 restricting movement of the joint portion 32, connection between the sleeve body 1 of the dusting cloth and the shank 3 is reinforced. In addition, the sleeve body 1 of the dusting cloth is effectively prevented from coming off the shank 3, now that the sleeve body 1 is fastened to the engaging hook 33 of the shank 3 and fixed in position via the through hole 111. In contrast to the prior art, in which the connection between the dusting cloth and the shank of a duster in the assembled state is so unreliable that the dusting cloth may easily get loose or even come off the shank, the present invention effectively prevents insecure connection between the dusting cloth and the shank and keeps the dusting cloth from getting loose or coming off. As such, the present invention features enhanced convenience of use.

In use, the shank 3 can be adjusted to the straight-line state, thereby straightening the sleeve body 1 of the dusting cloth and extending the duster to its full length. In this state, the pile layer 2 or the cloth strip layer is located on the bottom surface of the shank 3 and can be inserted into a narrow gap together with the shank 3 so as to clean the gap. The duster in this state is also suitable for cleaning a large-area surface.

The shank 3 can also be adjusted to the folded state, thereby folding the sleeve body 1 of the dusting cloth and shortening the duster. During the process, the engaging hook 33 of the shank 3 is inserted into the positioning hole 34 along the dividing portion 15 of the sleeve body 1 to secure the sleeve body 1 and the shank 3 in place. Once in the folded state, the pile layer 2 or the cloth strip layer is located on both sides of the shank 3, and the duster is covered all over with pile threads or cloth strips and is therefore suitable not only for removing dust from various kinds of dead corners but also for cleaning a complex surface.

The pile layer 2 or the cloth strip layer may alternatively be provided on the top surface of the sleeve body 1 such that, after the shank 3 is folded, the pile threads of the pile layer 2 or the cloth strips of the cloth strip layer extend outward of the periphery of the shank 3. Or, the pile layer 2 or the cloth strip layer may be provided on both the top surface and the bottom surface of the sleeve body 1. In that case, the shank 3 will be covered all over with pile threads or cloth strips.

Additionally, a width-reduced neck 18 is formed on the inner wall of the receiving groove 13 at a position corresponding to the joint portion 32. The neck 18 is formed along the horizontal direction of the surface of the sleeve body 1 so as to interfere with movement of the shank 3. More specifically, the neck 18 is formed between the hot-sealed nodes 43 on two lateral sides of the receiving groove 13. Thus, after the shank 3 is inserted into the receiving groove 13 through the sleeve opening 14, the neck 18 can interfere with movement of the shank 3 and restrict the shank 3 within the receiving groove 13, thereby further preventing the sleeve body 1 from coming off the shank 3.

Moreover, the peripheries of the first and the second cloth sheets 11, 12 may have contours characterized by alternating ridges and grooves (such as the wavy contours demonstrated in the present embodiment), and the pile threads of the pile layer 2 or the cloth strips of the cloth strip layer are distributed unevenly along these contours and are hence fluffier than when the contours are designed otherwise. This fluffy pile layer 2 or cloth strip layer is ideal for cleaning complex surfaces.

What is claimed is:

1. A dusting cloth structure for use with a duster, comprising a sleeve body having an outer surface provided with either a pile layer or a cloth strip layer, the sleeve body having a receiving groove therein for receiving an external duster shank, the sleeve body having an end formed with a sleeve opening in communication with the receiving groove, the dusting cloth structure being characterized in that:

a portion of the sleeve body that is away from the sleeve opening is formed with a dividing portion extending toward the sleeve opening, the dividing portion defining two end grooves in the sleeve body, the end grooves being divided from each other and in communication with the receiving groove, the receiving groove having an inner wall formed with a joint accommodating groove along a vertical direction of a surface of the sleeve body.

2. The dusting cloth structure of claim 1, wherein the pile layer or the cloth strip layer is located on a single side of the sleeve body.

3. The dusting cloth structure of claim 1, wherein the sleeve body is composed of a first cloth sheet and a second cloth sheet bonded together, the receiving groove and the end grooves being formed between the first cloth sheet and the second cloth sheet, the sleeve opening being formed between an end side of the first cloth sheet and a corresponding end side of the second cloth sheet, the joint accommodating groove being formed on an inner side of the first cloth sheet, the end grooves being configured to be respectively inserted by two insertion legs provided at a front end of the external duster shank, the joint accommodating groove being configured to receive a joint portion provided in a middle section of the external duster shank.

4. The dusting cloth structure of claim 3, wherein a periphery of the first cloth sheet and a periphery of the second cloth sheet are hot-pressed together to form a plurality of hot-sealed nodes and to thereby bond the first cloth sheet and the second cloth sheet together.

5. The dusting cloth structure of claim 1, wherein a portion of the sleeve body that corresponds in position to an area between two insertion legs provided at a front end of the external duster shank is hot-pressed to form a plurality of hot-sealed nodes, the hot-sealed nodes constituting the dividing portion.

6. The dusting cloth structure of claim 5, wherein the sleeve body is formed with a through hole adjacent to the sleeve opening, and an engaging hook on the external duster shank can extend out of the sleeve body through the through hole such that the sleeve body is fastened to the engaging hook of the external duster shank and secured in position through the through hole.

7. The dusting cloth structure of claim 6, wherein the insertion legs are formed therebetween with a positioning hole corresponding in position to the dividing portion, and the engaging hook can be inserted into the positioning hole along the dividing portion.

8. The dusting cloth structure of claim 1, wherein the inner wall of the receiving groove is formed with a width-reduced neck along a horizontal direction of the surface of the sleeve body.

9. The dusting cloth structure of claim 1, wherein the sleeve body has a periphery having a contour characterized by alternating ridges and grooves, and pile threads of the pile layer or cloth strips of the cloth strip layer are unevenly distributed along the contour characterized by the alternating ridges and grooves.

* * * * *